US010895822B2

(12) United States Patent
Kojima et al.

(10) Patent No.: US 10,895,822 B2
(45) Date of Patent: Jan. 19, 2021

(54) IMAGE FORMING APPARATUS

(71) Applicant: CANON KABUSHIKI KAISHA, Tokyo (JP)

(72) Inventors: Takehiro Kojima, Tokyo (JP); Teppei Nagata, Abiko (JP); Ryota Fujioka, Kashiwa (JP); Shota Takami, Kamagaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/684,782

(22) Filed: Nov. 15, 2019

(65) Prior Publication Data

US 2020/0081369 A1 Mar. 12, 2020

Related U.S. Application Data

(63) Continuation of application No. PCT/JP2018/019722, filed on May 22, 2018.

(30) Foreign Application Priority Data

May 23, 2017 (JP) ..... 2017-102111

(51) Int. Cl.
*G03G 15/06* (2006.01)
*G03G 15/095* (2006.01)

(52) U.S. Cl.
CPC ..... *G03G 15/065* (2013.01); *G03G 15/095* (2013.01)

(58) Field of Classification Search
CPC ..... G03G 15/065
USPC ..... 399/55
See application file for complete search history.

(56) References Cited

U.S. PATENT DOCUMENTS

| | | | | |
|---|---|---|---|---|
| 6,085,054 | A | 7/2000 | Kusayanagi | |
| 9,141,036 | B2 | 9/2015 | Berg | |
| 9,244,390 | B2 | 1/2016 | Lam et al. | |
| 2006/0182456 | A1* | 8/2006 | Naoi | G03G 15/0266 399/50 |
| 2012/0155892 | A1* | 6/2012 | Ishida | G03G 15/0893 399/27 |
| 2013/0011162 | A1 | 1/2013 | Nelson et al. | |
| 2017/0168414 | A1* | 6/2017 | Suzuki | G03G 15/0121 |
| 2018/0231922 | A1* | 8/2018 | Nelson | G03G 15/11 |

FOREIGN PATENT DOCUMENTS

| | | | |
|---|---|---|---|
| JP | 11-327312 | A | 11/1999 |
| JP | 2008-020765 | A | 1/2008 |
| JP | 2008-102415 | A | 5/2008 |
| JP | 2014-146032 | A | 8/2014 |
| WO | 2017/030580 | A1 | 2/2017 |

OTHER PUBLICATIONS

International Search Report dated Jun. 26, 2018, in International Patent Application No. PCT/JP2018/019722.

* cited by examiner

*Primary Examiner* — Walter L Lindsay, Jr.
*Assistant Examiner* — Philipmarcus T Fadul
(74) *Attorney, Agent, or Firm* — Venable LLP

(57) ABSTRACT

An image forming apparatus includes a control unit configured to execute a stop mode in which, after image forming operation is stopped, a developer bearing member is rotated for a predetermined time with a potential difference between a film forming electrode and a developer bearing member set to zero or smaller than that during image formation, and thereafter, the rotation of the developer bearing member is stopped.

7 Claims, 7 Drawing Sheets

IMAGE FORMING APPARATUS

CROSS-REFERENCE TO RELATED APPLICATIONS

This application is a Continuation of International Patent Application No. PCT/JP2018/019722, filed May 22, 2018, which claims the benefit of Japanese Patent Application No. 2017-102111, filed May 23, 2017, both of which are hereby incorporated by reference herein in their entirety.

BACKGROUND OF THE INVENTION

Field of the Invention

The present invention relates to an image forming apparatus that adopts an electrophotographic system and that is configured to form an image using liquid developer.

Description of the Related Art

Hitherto, an image forming apparatus is known where an electrostatic latent image formed on a charged photosensitive member is developed as toner image using liquid developer containing toner in the form of particles and carrier liquid, and the developed toner image is transferred to a recording material. Liquid developer is stored in a mixer and supplied from the mixer to the developing apparatus. In the developing apparatus, liquid developer is borne on a rotating developing roller, and the liquid developer borne on the developing roller is used to develop electrostatic latent image formed on the photosensitive member into a toner image. The development of toner image is performed by movement of toner in a layer of liquid developer formed between a developing roller and the photosensitive member according to an electric field formed by application of voltage to the developing roller (so-called electrophoresis).

Further according to the developing apparatus disclosed in U.S. Pat. No. 9,244,390, toner contained in the liquid developer borne on the developing roller that has not been used for developing image is collected from the developing roller by electrophoresis using a cleaning roller abutted against the developing roller. Toner collected from the developing roller by the cleaning roller is removed mechanically from the cleaning roller by a cleaning blade that is slid against the cleaning roller.

Not only the cleaning roller but a squeezing roller and the like are abutted against the developing roller, and in a state where the rotation of such rollers is stopped, liquid developer will remain at a nip portion between the developing roller and other roller members. The amount of remaining liquid developer may be reduced with elapse of time by evaporation or flowing of carrier liquid. However, since only carrier liquid is reduced from the residual liquid developer, toner in the liquid developer may be concentrated and may easily attach to the roller member, which is not preferable since it may cause image defects.

Therefore, according to Japanese Patent Application Laid-Open Publication No. 11-327312, an image forming apparatus is proposed where liquid developer remaining between the developing roller and other roller members, that is, in the nip portion, is reduced by rotating the squeezing roller in a direction opposite from that during image formation when the image forming operation is stopped. In this case, liquid developer remaining between the developing roller and other roller members is reduced, so that the amount of toner is reduced compared to the case where residual liquid developer is not reduced, and therefore, toner adhesion to respective roller members is less likely to occur.

However, according to the conventional apparatuses described above, liquid developer remaining between the developing roller and other roller members can be reduced, but toner removed by the cleaning blade from the cleaning roller tended to remain on the cleaning blade. Therefore, toner remaining on the cleaning blade was concentrated, and concentrated toner not only deteriorated cleaning performance but also adhered to the developing roller through the cleaning roller and caused image defects.

SUMMARY OF THE INVENTION

According to one aspect of the present invention, an image forming apparatus includes a photosensitive member, a rotatable developer bearing member configured to bear liquid developer containing toner and carrier liquid and develop, by being applied voltage, an electrostatic latent image formed on the photosensitive member at a developing portion, a feeding unit configured to feed liquid developer to the developer bearing member, a film forming electrode arranged downstream of the feeding unit in a direction of rotation of the developer bearing member and configured to form a film of liquid developer being supplied to the developer bearing member in a state where a voltage is applied thereto, an abutment roller arranged downstream of the film forming electrode and upstream of the developing portion in the direction of rotation and configured to abut against the developer bearing member, a cleaning roller arranged downstream of the developing portion and upstream of the feeding unit in the direction of rotation and configured to abut against the developer bearing member and remove toner on the developer bearing member after developing image, a removing member configured to abut against the cleaning roller and remove toner on the cleaning roller, and a control unit configured to execute a stop mode in which, after image forming operation is stopped, the developer bearing member is rotated for a predetermined time with a potential difference between the film forming electrode and the developer bearing member set to zero or smaller than that during image formation, and thereafter, the rotation of the developer bearing member is stopped.

Further features of the present invention will become apparent from the following description of exemplary embodiments with reference to the attached drawings.

DESCRIPTION OF THE EMBODIMENTS

Image Forming Apparatus

Figure 1:
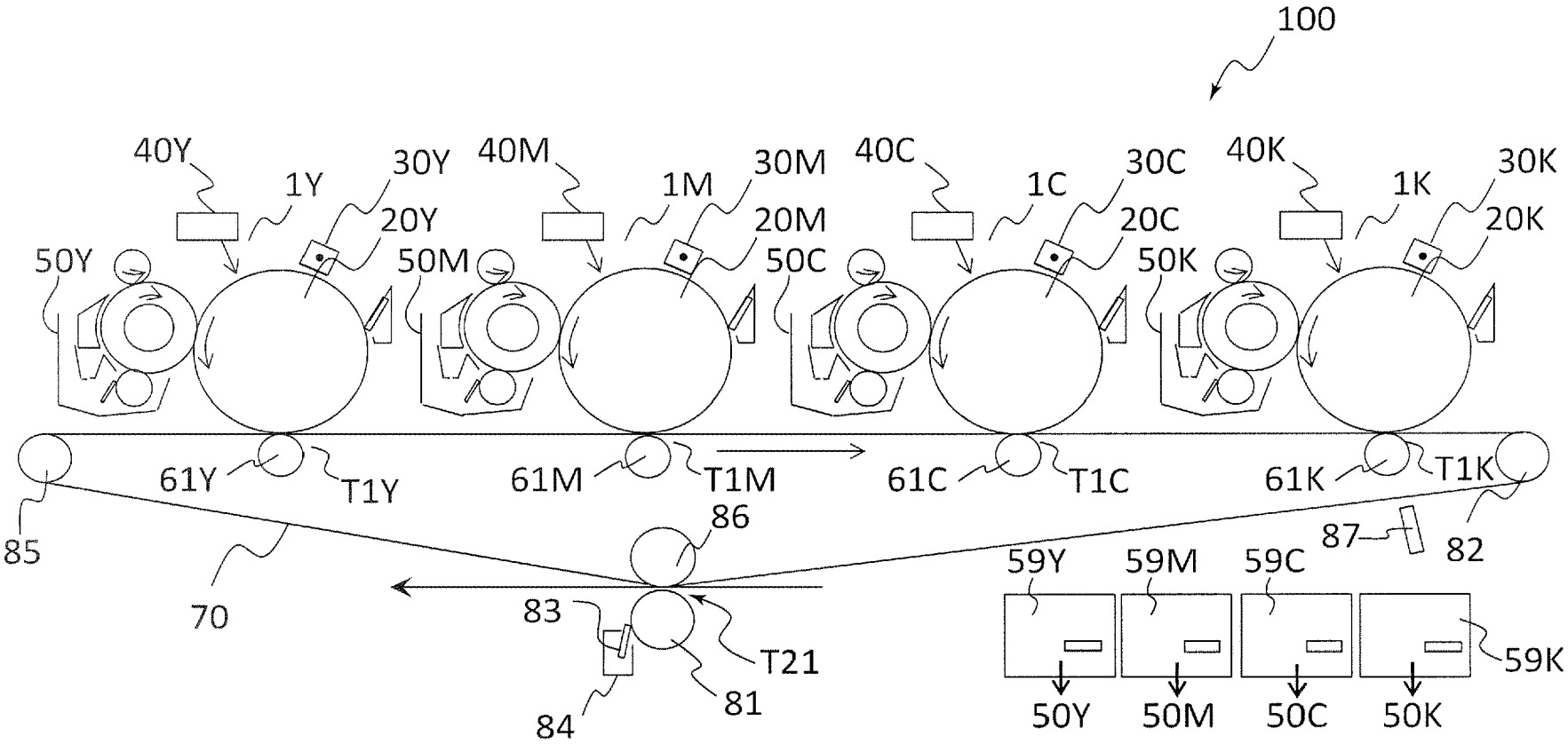
FIG. 1 is a schematic drawing illustrating a configuration of an image forming apparatus according to a present embodiment.

A general configuration of an image forming apparatus according to the present embodiment will be described with reference to FIG. 1. As illustrated in FIG. 1, an image forming apparatus 100 is a full-color printer of an electrophotographic system including four image forming units 1Y, 1M, 1C and 1K corresponding to yellow (Y), magenta (M), cyan (C) and black (K). In the present embodiment, a tandem-type configuration is adopted where the image forming units 1Y, 1M, 1C and 1K are arranged along a direction of rotation of an intermediate transfer belt 70. The image forming apparatus 100 forms a toner image on a recording material according to an image signal received from an external device (not shown) connected in a communicatable manner to the image forming apparatus body. Examples of the recording material include paper sheet, plastic film, cloth and so on.

The respective image forming units 1Y, 1M, 1C and 1K form toner images of respective colors on photosensitive members 20Y, 20M, 20C and 20K, that is, on the image bearing members using liquid developer containing toner and carrier liquid. Detailed configuration of the image forming units will be described later.

The intermediate transfer belt 70 serving as an intermediate transfer body is an endless belt stretched across a drive roller 82, a driven roller 85 and a secondary transfer inner roller 86, and it is driven to rotate while abutting against photosensitive members 20Y, 20M, 20C and 20K and a secondary transfer outer roller 81. Primary transfer rollers 61Y, 61M, 61C and 61K are respectively arranged at positions opposed to photosensitive members 20Y, 20M, 20C and 20K with the intermediate transfer belt 70 interposed, by which primary transfer portions T1Y, T1M, T1C and T1K. Toner images of four colors are respectively sequentially transferred in an overlapped manner to the intermediate transfer belt 70 from respective photosensitive members 20Y, 20M, 20C and 20K at the respective primary transfer portions T1Y, T1M, T1C and T1K, and a full color toner image is formed on the intermediate transfer belt 70. It is also possible to form a toner image of a single color, such as black, on the intermediate transfer belt 70.

The secondary transfer outer roller 81 is arranged at a position opposed to the secondary transfer inner roller 86 interposing the intermediate transfer belt 70, forming a secondary transfer portion T21. The mono-color toner image or full-color toner image formed on the intermediate transfer belt 70 is transferred to the recording material at the secondary transfer portion T21. By applying voltage of +1000 V, for example, to the secondary transfer outer roller 81 while maintaining the secondary transfer inner roller 86 to 0 V at the secondary transfer portion T21, toner on the intermediate transfer belt 70 is secondarily transferred to the recording material. The toner image transferred to the recording material is fixed to the recording material by a fixing unit not shown.

Liquid developer that has not been transferred to the recording material is removed from the intermediate transfer belt 70 by a cleaning device (not shown) abutted against the intermediate transfer belt 70. Further, a blade 83 is abutted against the secondary transfer outer roller 81, and the liquid developer attached to the secondary transfer outer roller 81 is scraped by the blade 83 and collected at a collecting portion 84.

Further, a toner image density sensor 87 is arranged upstream of the secondary transfer portion T21 in the direction of rotation of the intermediate transfer belt 70. A test image for monitoring the density of image is formed periodically on the intermediate transfer belt 70 during image forming operation, and the toner image density sensor 87 detects the density of the test image. The toner image density sensor 87 is an optical sensor, for example, and it detects density of the test image based on intensity of regular and diffused reflection lights of LED light irradiated on the test image. Based on the density information of test image being detected, optimization of image density is performed by feedback control. Specifically, image density is adjusted by changing voltage applied to a film forming electrode 51 described later.

Image Forming Unit

The image forming units 1Y, 1M, 1C and 1K will be described with reference to FIGS. 1 and 2. The image forming units 1Y, 1M, 1C and 1K respectively include developing apparatuses 50Y, 50M, 50C and 50K. The developing apparatuses 50Y, 50M, 50C and 50K store liquid developer containing colored toner of yellow (Y), magenta (M), cyan (C) and black (K), respectively. The developing apparatuses 50Y, 50M, 50C and 50K have a function to develop the electrostatic latent image formed on respective photosensitive members 20Y, 20M, 20C and 20K into a toner image using respective liquid developer.

The four image forming units 1Y, 1M, 1C and 1K have approximately the same configuration, except for the difference in the developer color. Therefore, in the following description, the image forming unit 1K will be described with reference to FIG. 2 as an example, and the other image forming units will not be described. Suffix corresponding to respective colors (Y, M, C, K) are added to reference numbers of the respective components of FIG. 1.

A charging device 30K for charging a photosensitive member 20K, an exposing unit 40K for forming an electrostatic latent image on the photosensitive member 20K being charged, a developing apparatus 50K, a cleaning device 21K and so on are arranged around the photosensitive member 20K along the direction of rotation thereof.

The photosensitive member 20K is a photosensitive drum formed in a cylindrical shape, composed of a cylindrical base material and a photosensitive layer formed on an outer peripheral surface thereof, and is rotatable around a central axis. The photosensitive layer is composed of an organic photosensitive member or an amorphous silicon photosensitive member, for example. In the present embodiment, the photosensitive member 20K forms a photosensitive layer by a mixture of amorphous silicon and amorphous carbon, and a diameter thereof is set to 84 mm. The photosensitive member 20K can bear an electrostatic latent image described later. In the present embodiment, the photosensitive member 20K is rotated in a counterclockwise direction, as illustrated by the arrow in FIG. 2.

The charging device 30K is a device for charging the photosensitive member 20K. The present embodiment uses a corona charger. The charging device 30K is provided upstream of a nip portion between the photosensitive member 20K and a developing roller 54 described later, and charges the photosensitive member 20K by having a bias having a same polarity as toner applied from a power supply unit not shown. In the present embodiment, the surface of the photosensitive member 20K is charged to approximately −500 V by having a voltage of approximately −4.5 kV to −5.5 kV applied to a charging wire of the charging device 30K.

The exposing unit 40K includes a semiconductor laser, a polygon mirror, an F-θ lens and the like, and irradiates laser modulated according to image signals to form an electrostatic latent image on the photosensitive member 20K to form an electrostatic latent image on the photosensitive member 20K. In other words, an electrostatic latent image is borne on the photosensitive member 20K. In the present embodiment, an electrostatic latent image is formed on the surface of the photosensitive member 20K so that a potential of image area is set to approximately −100 V by the exposing unit 40K.

The developing apparatus 50K is a device for developing the electrostatic latent image formed on the photosensitive member 20K to a toner image using black (K) toner. The details of the developing apparatus 50K will be described later. The toner image formed on the photosensitive member 20K is primarily transferred to the intermediate transfer belt 70 by having transfer voltage applied between a primary transfer roller 61K and the photosensitive member 20K. The cleaning device 21K includes a cleaning blade 21Ka and a collecting portion 21Kb and collects liquid developer on the photosensitive member 20K after primary transfer has been performed.

Developing Apparatus

Next, a configuration of the developing apparatus 50K according to the present embodiment will be described with reference to FIG. 2. The developing apparatus 50K includes the developing roller 54 that serves as a developer bearing member that bears liquid developer and conveys the same to the photosensitive member 20K. A developer tank 53, a film forming electrode 51, a squeezing roller 52 serving as an abutment roller, and a cleaning roller 58 serving as a cleaning roller are arranged around the developing roller 54. The developing apparatus 50K includes, in addition to the developing roller 54, the developer tank 53, the film forming electrode 51, the squeezing roller 52 and the cleaning roller 58, a developer collecting tank 55 described later.

Voltages applied from respective power supplies described later are applied to the developing roller 54, the film forming electrode 51, the squeezing roller 52 and the cleaning roller 58. Then, according to the potential difference of voltages applied to the respective components, toner in the liquid developer is moved to a desired direction in the liquid layer by electrophoresis. In the present embodiment, voltages applied respectively to the developing roller 54, the film forming electrode 51, the squeezing roller 52 and the cleaning roller 58 are all negative voltage.

The developing roller 54 bears liquid developer containing particulate toner and carrier liquid and rotates, and develops an electrostatic latent image borne on the photosensitive member 20K by toner at a developing position, that is, developing portion g, opposed to the photosensitive member 20K. The developing roller 54 is a cylindrical member having a diameter of 42 mm, for example, and it rotates clockwise around a central axis, as illustrated by arrow P of FIG. 2. The developing roller 54 includes an elastic layer composed of conductive polymer and the like having a thickness of 5 mm provided on an outer periphery of a metallic inner core formed of stainless steel and the like.

A surface layer member of the developing roller 54 is a conductive elastic layer in which particles having conductivity are mixed and dispersed as electric resistance adjustment material in resin. Examples of resin include EPDM, urethane, silicon, nitrile butadiene rubber, chloroprene rubber, styrene-butadiene rubber and butadiene rubber. As surface layer member, a dispersion-type resistance adjustment resin in which particles having conductivity, such as carbon and/or titanium oxide, serving as electric resistance adjustment material are dispersed and mixed in resin selected from those listed above is used. As another example, the surface layer member can use electric resistance adjustment resin using one or a plurality of ionic conducting materials such as sodium perchlorate, calcium perchlorate, sodium chloride in resin selected from those listed above as base.

The surface layer member has a volume resistivity of approximately $1\times10^{2}$ to $1\times10^{12}$ Ω·cm including dispersion. Further, if a foaming agent is to be used in a foaming and mixing process for acquiring elasticity, silicon-based surfactant (polydialsiloxane, polysiloxane·polyalkylenoxide block copolymer) is appropriate. In the present embodiment, a surface layer of the developing roller 54 is formed of urethane rubber having conductivity, in which ion conductive agent is uniformly dispersed in a surface layer of the developing roller 54, with volume resistivity adjusted for example to $1\times10^{5}$ to $1\times10^{7}$ Ω·cm in the initial state.

The developer tank 53 stores liquid developer in which black toner is dispersed in a carrier liquid. Liquid developer utilized in the present embodiment is mainly composed of particles having a mean particle diameter of 0.7 μm in which a coloring agent such as a pigment dispersed in a polyester-based resin added to a carrier liquid such as an organic solvent, together with a dispersion agent, toner charge control agent and charge directing agent. The toner surface is charged for a certain amount to negative polarity. In the case of the present embodiment, respective specific gravities of toner and carrier liquid are 1.35 g/cm$^3$ and 0.83 g/cm$^3$, for example. Moving amount and pressing amount of toner can vary according to the adjustment potential difference set among respective components.

Further, the developer tank 53 is capable of supplying stored liquid developer to the developing roller 54. That is, the developer tank 53 is a feeding unit for storing liquid developer for developing the electrostatic latent image formed on the photosensitive member 20K and supplying the liquid developer to the developing roller 54.

The liquid developer stored in the developer tank 53 is supplied from a mixer 59K. Carrier liquid and toner are replenished suitably to the mixer 59K from a carrier tank storing carrier liquid for replenishment and a toner tank storing toner for replenishment, for example. An agitating blade driven by a motor not shown is stored in the mixer 59K, and the supplied carrier liquid and toner are agitated and mixed, by which toner is dispersed in the carrier liquid.

In the mixer 59K, density of toner (toner density, T/D) in the liquid developer is adjusted. Here, toner density is denoted by weight percent density (wt %) of toner in the liquid developer. In the present embodiment, liquid developer adjusted in the mixer 59K to have a toner density of 3.5±0.5 wt %, for example, is supplied to the developer tank 53 through a developer supply port 531 connected to the mixer 59K.

The developer tank 53 is provided with a guide member 533 that forms a flushing channel 57, and a developer discharge port 532. Liquid developer in the developer tank 53 leaks through the developer discharge port 532 provided on a bottom of the developer tank 53 and is collected in the developer collecting tank 55. Therefore, in a case where feeding of liquid developer to the developer tank 53 is stopped, for example when the image forming operation is stopped, the amount of liquid developer stored in the developer tank 53 is reduced gradually, and finally, the developer tank 53 becomes empty.

Figure 2:
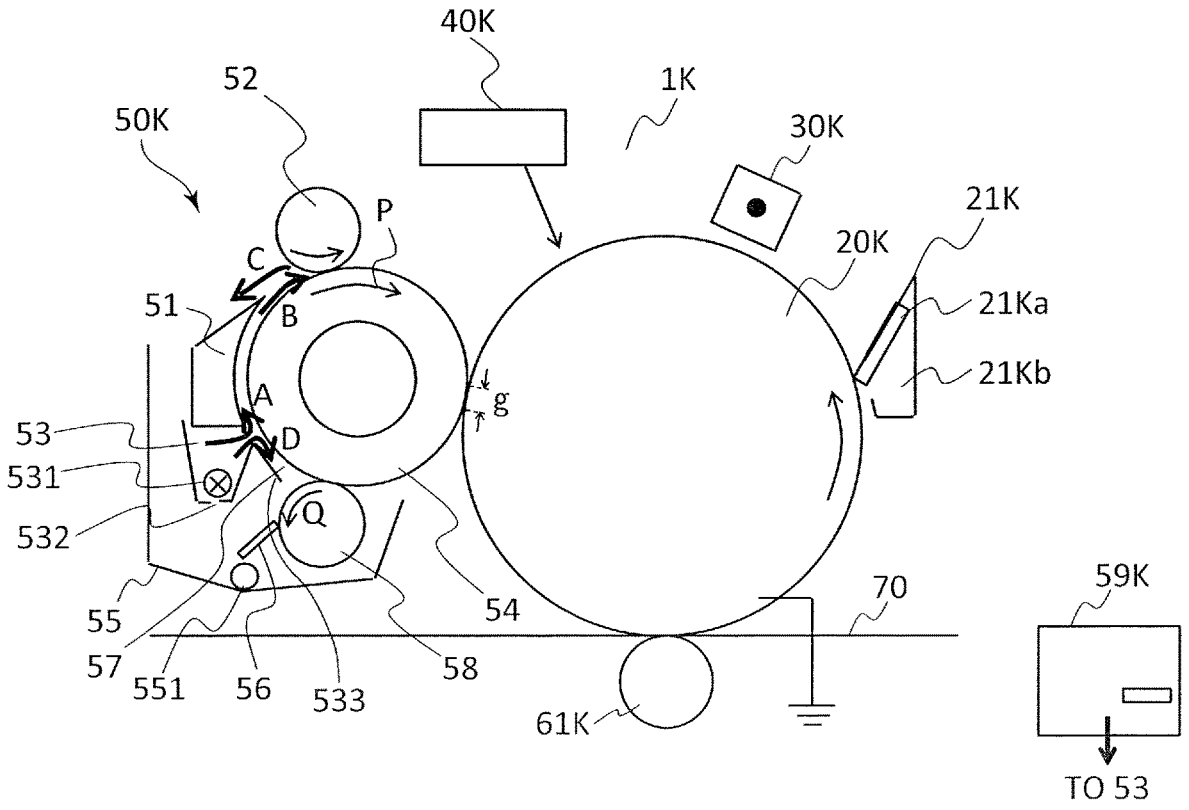
FIG. 2 is a cross-sectional view illustrating an image forming unit according to the present embodiment.

Now, flushing refers to flowing liquid developer having low toner density supplied to the developer tank 53 to the nip portion between the developer roller 54 and the cleaning roller 58, as illustrated in arrow D of FIG. 2. In a state where flushing is performed, liquid developer having a low toner density is also supplied to the contact portion (that is, near a leading edge of the blade) between the cleaning roller 58 and a cleaning blade 56.

Figure 3:
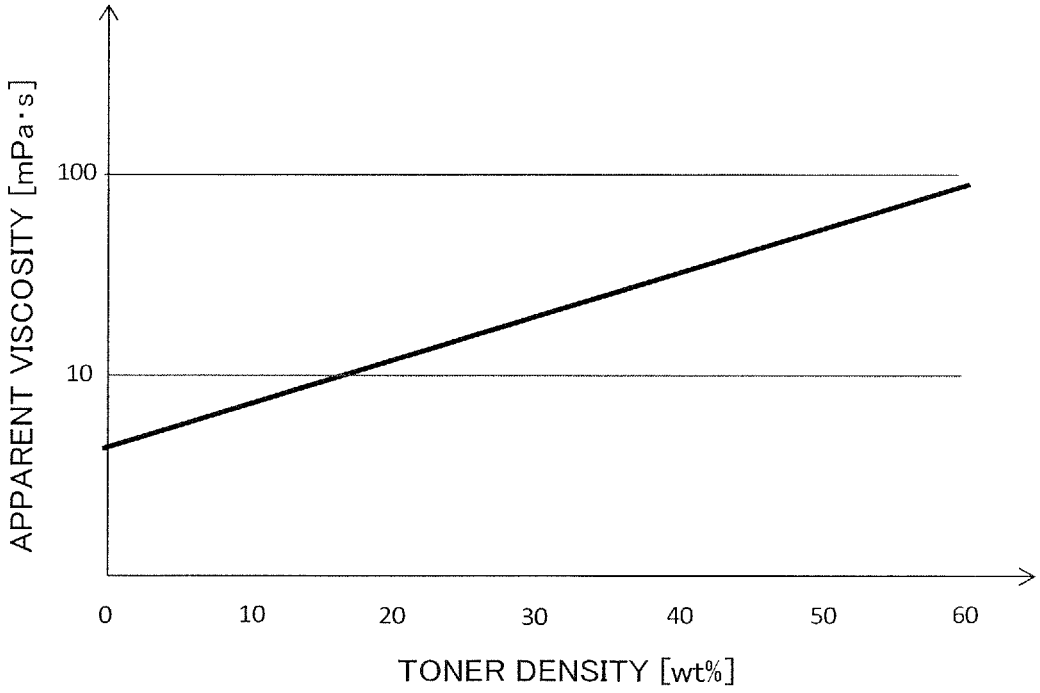
FIG. 3 is a graph illustrating a relationship between toner density in liquid developer and apparent viscosity.

We will briefly describe the flushing process. Liquid developer collected together with toner by the cleaning roller 58 may have a high toner density. If the toner density of liquid developer is high, the apparent viscosity of liquid developer becomes high. FIG. 3 illustrates a relationship between toner density of liquid developer and apparent viscosity of liquid developer. As illustrated in FIG. 3, as the toner density of liquid developer increases, the apparent viscosity of liquid developer is increased in proportion thereto. The apparent viscosity of liquid developer collected by the cleaning roller 58 may become as high as approximately 100 to 140 mPa·s.

If the apparent viscosity of liquid developer collected by the cleaning roller 58 is high, liquid developer will not easily flow along the surface of the cleaning blade 56 toward the developer collecting tank 55. As a result, toner scraped by the cleaning blade 56 will not easily flow with the liquid developer, and toner tends to remain on the cleaning blade 56. In order to avoid this problem, flushing is performed so that liquid developer having a low toner density, which is approximately 3.5 wt % according to the present embodiment, supplied to the developer tank 53 is also flown toward the cleaning roller 58.

Toner density of liquid developer at the point of time when the liquid developer is collected by the cleaning roller 58 differs according to the image being formed. Toner density becomes highest in a state where image forming is performed to form a solid white image on the whole surface, and in that case, the toner density of liquid developer when the liquid developer is collected by the cleaning roller 58 is approximately 65 wt %. Further, if developing of toner image is not performed, a portion of liquid developer having passed the squeezing roller 52 is directly collected by the cleaning roller 58, and when the developer is collected by the cleaning roller 58, the toner density of liquid developer becomes approximately 60 wt %. However, the toner density of liquid developer collected by the cleaning roller 58 is lowered to approximately 10 wt % by the above-described flushing process. The apparent viscosity of liquid developer in a case where the toner density is approximately 10 wt % is approximately 8.0 mPa·s, as illustrated in FIG. 3. Therefore, in the cleaning blade 56, toner being scraped is flushed by the flushing process and collected together with the liquid developer in the developer collecting tank 55. Thereby, remaining of toner on the cleaning blade 56 can be suppressed by the flushing process.

Returning to FIG. 2, the film forming electrode 51 forms a film of liquid developer supplied from the developer tank 53 on the developing roller 54 and moves the toner toward the developing roller 54, that is, toward the developer bearing member, by the operation of electric field. That is, the film forming electrode 51 is arranged to oppose to the developing roller 54 with a predetermined gap formed therebetween at a position upstream of the developing position with respect to the direction of rotation of the developing roller 54. Then, voltage, referred to as film forming voltage, is applied to the film forming electrode 51 from the film forming power supply 201 (refer to FIG. 4).

Specifically, a surface of the film forming electrode 51 opposed to the developing roller 54 has a circumferential length of 24 mm, and forms a gap (predetermined gap) of 400±100 μm with the developing roller 54. Liquid developer supplied to the developer tank 53 is drawn toward the gap between the film forming electrode 51 and the developing roller 54 by the rotation of the developing roller 54, as illustrated by arrow A of FIG. 2. Then, toner is drawn toward the developing roller 54 by electric field generated at the predetermined gap according to the difference of voltages between the film forming voltage applied to the film forming electrode 51 and voltage, called developing voltage, applied to the developing roller 54. In the present embodiment, the film forming voltage and the developing voltage are set so that an electric field is generated in the direction from the film forming electrode 51 toward the developing roller 54.

The squeezing roller 52 is arranged downstream of the film forming electrode 51 and upstream of the developing position with respect to the direction of rotation of the developing roller 54, and presses toner in the liquid developer formed as a film on the developing roller 54, that is, on the developer bearing member, against the developing roller 54. That is, by having a predetermined voltage called squeezing voltage applied from a squeezing power supply 203 (FIG. 4), the squeezing roller 52 moves toner contained in the liquid developer formed as a film on the developing roller 54 toward the developing roller 54 by electric field, and at the same time, squeezes and collects excessive carrier liquid. In the present embodiment, squeezing voltage and developing voltage are set so that electric field is generated in a direction from the squeezing roller 52 toward the developing roller 54.

The squeezing roller 52 described above is a cylindrical member formed of metal, and in the present embodiment, a roller having a diameter of 16 mm and formed of stainless steel is used. The squeezing roller 52 is abutted against the developing roller 54 with a fixed pressure (35±5 N in the present embodiment) across the longitudinal direction, that is, rotational axis direction of the developing roller 54, the length being 354 mm according to the present embodiment. The squeezing roller 52 is rotated in the counterclockwise direction as illustrated in FIG. 2.

A fixed amount of liquid developer drawn from the developer tank 53 and passing the film forming electrode 51 is borne on the developing roller 54. Therefore, as illustrated in arrow B of FIG. 2, a certain amount of liquid developer existing on the surface of the developing roller 54 among the liquid developer conveyed to the nip portion between the squeezing roller 52 and the developing roller 54 at predetermined speed stably forms a nip portion between the squeezing roller 52 and the developing roller 54. According to the present embodiment, the gap of the nip portion is approximately 6 μm, and the width thereof in the direction of rotation is approximately 3 mm.

In the nip portion, toner is pressed against the developing roller 54 by electric field generated by potential difference between the voltage applied to the squeezing roller 52 and the developing voltage applied to the developing roller 54. Near the exit between the squeezing roller 52 and the developing roller 54, liquid developer is separated and borne on the surfaces of the respective rollers. In this state, almost all the toner and carrier liquid present at the nip portion corotates with the developing roller 54 and only carrier liquid corotates with the squeezing roller 52. Thereby, liquid developer on the developing roller 54 is concentrated and the toner density of liquid developer becomes higher than 10 times the toner density of liquid developer in the developer tank 53, which is approximately 3.5 wt %. In the present embodiment, toner density of liquid developer on the developing roller 54 after passing the nip portion is 40±5 wt %.

Meanwhile, liquid developer having passed the gap between the film forming electrode 51 and the developing roller 54 and not entering the nip portion between the squeezing roller 52 and the developing roller 54 is rebounded by the squeezing roller 52, as illustrated by arrow C of FIG. 2. Then, it is flown to the rear side of the film forming electrode 51 and is collected in the developer collecting tank 55.

The cleaning roller 58 collects toner on the developing roller 54, that is, on the developer bearing member, that has not contributed to image forming at the developing position by the operation of electric field. That is, the cleaning roller 58 is arranged at a cleaning position downstream of the developing position in the direction of rotation of the developing roller 54, and in a state where cleaning voltage is applied from a cleaning power supply 204, toner having passed through the developing position and remaining on the developing roller 54 after developing image is cleaned. Specifically, the cleaning roller 58 rotates while collecting toner from the liquid developer on the developing roller 54 by electric field generated by the difference between the applied voltage to the developing roller 54. In the present embodiment, cleaning voltage and developing voltage are set so that electric field is generated in a direction toward the cleaning roller 58 from the developing roller 54.

The above-described cleaning roller 58 abuts against the surface of the developing roller 54 and rotates in a counterclockwise direction illustrate by arrow Q of FIG. 2, and it is a metal roller formed of stainless steel or aluminum. In the present embodiment, a roller having a diameter of 16 mm formed of stainless steel, for example, is used as the cleaning roller 58.

Toner collected by the cleaning roller 58 is removed by the cleaning blade 56 serving as a removing member. The cleaning blade 56 is arranged so that its leading-edge abuts against the cleaning roller 58 at a position downstream of the position opposed to the developing roller 54, i.e., cleaning position, with respect to the direction of rotation of the cleaning roller 58. The cleaning blade 56 removes the toner on the cleaning roller 58 (on the cleaning roller). The cleaning roller 58 from which toner has been removed by the cleaning blade 56 collects toner from the developing roller 54 again. The cleaning blade 56 is a metal blade formed of stainless steel having a thickness of 0.2 mm and a free length of 20 mm, for example. The cleaning blade 56 abuts against the cleaning roller 58 in a counter direction.

Further, liquid developer collected from the developing roller 54 by the cleaning roller 58 and liquid developer supplied to the cleaning roller 58 by flushing is collected by the cleaning blade 56 to the developer collecting tank 55. Liquid developer collected in the developer collecting tank 55 is discharged from a developer discharge port 551 and passes through a developer circulation circuit not shown to be supplied to the mixer 59K again.

In the present embodiment, an image forming process speed for rotating the photosensitive member 20K is 785 mm/s, and the respective roller members described above that contribute to image forming respectively rotate so that their respective surface peripheral speeds become 785 mm/s.

Control Unit

Next, a configuration of a control system in the image forming apparatus 100 described above will be described. The image forming apparatus 100 according to the present embodiment comprises a control unit 110. The control unit 110 will be described with reference to FIG. 4. Various devices such as motors and power supplies for operating the present image forming apparatus 100 other than those illustrated are connected to the control unit 110, but they are not shown and descriptions thereof are omitted since they do not relate to the main object of the present invention.

The control unit 110 performs various control of image forming operation and the like of the present image forming apparatus 100, and a CPU (Central Processing Unit) 111 is provided in the control unit 110. Further, a ROM (Read Only Memory) 112*a* is provided in a memory 112. Various program and data for controlling the image forming apparatus 100 are stored in the ROM 112*a*. The control unit 110 can control the image forming apparatus 100 to execute the image forming job (program) stored in the ROM 112*a* to perform image forming. In the case of the present embodiment, the control unit 110 can execute an operation stop control (stop mode) for stopping the operation of the developing apparatus 50K when the image forming job is completed, that is, during post-rotation. The operation stop control of the developing apparatus 50K will be described later (refer to FIGS. 5 to 7). A RAM (Random Access Memory) 112*b* in which working data read from various sensors and the like and input data are stored is also included in the memory 112. The CPU 111 refers to data stored in the RAM 112*b* and performs control based on the aforementioned programs and the like.

An image forming job refers to a series of actions from the start of image forming operation based on a print signal to form an image on a recording material to the completion of the image forming operation. That is, the image forming job refers to a series of actions from when a preliminary action, so-called pre-rotation, necessary for forming an image to when preliminary action, so-called post-rotation, necessary for ending the image forming process is completed after the image forming process has been performed. Specifically, it refers to the time from pre-rotation, which is a preparation action before image formation, after reception of a print signal, i.e., reception of an image forming job, to post-rotation, which is an operation after image forming, including the image forming period and interval between sheets. In the present specification, post-rotation refers to a period of time from end of final image formation of the image forming job to stopping of rotation of photosensitive members 20Y to 20K and the intermediate transfer belt 70 that are continuously rotated without forming a toner image.

Further, the control unit 110 is connected to the toner image density sensor 87. The control unit 110 adjusts voltage applied to the film forming electrode 51, for example, based on the detection result of the toner image density sensor 87. Further, the control unit 110 is connected to control targets such as a developer supply operation unit 200, the film forming power supply 201, an image developing power supply 202, the squeezing power supply 203, the cleaning power supply 204, an image development attaching/detaching motor 205, a developing roller motor 206 and the like. The developer supply operation unit 200 is a valve or a pump, for example, and liquid developer is supplied to the developer tank 53 based on a command from the control unit 110.

The film forming power supply 201, the image developing power supply 202, the squeezing power supply 203 and the cleaning power supply 204 that serve as voltage application units are respectively capable of applying voltage variably to the film forming electrode 51, the developing roller 54, the squeezing roller 52 and the cleaning roller 58. The image development attaching/detaching motor 205 serving as an abutment/separation unit moves the developing apparatus 50K to thereby move the developing roller 54 between an abutment position in which the developing roller 54 is abutted against the photosensitive member 20K and a separated position in which it is separated from the photosensitive member 20K. The developing roller motor 206 serving as a drive unit drives the developing roller 54 to rotate. The developing apparatuses 50Y, 50M and 50C are configured similarly.

Image Forming Operation

The image forming operation of the image forming apparatus 100 according to the present embodiment will be explained. In the following description, the image forming unit 1K is described as an example, but the other image forming units are configured similarly. Liquid developer including a toner layer borne on the developing roller 54 forms a visible image, i.e., toner image, based on a latent image formed on the photosensitive member 20K at a developing position where the developing roller 54 and the photosensitive member 20K are opposed.

As described, the electrostatic latent image formed on the photosensitive member 20K upstream of the developing position is developed by toner at the developing position and becomes a toner image. At the developing position, a developing voltage of approximately −300 V according to the present embodiment is applied from the image developing power supply 202 to the developing roller 54. Thereby, toner is moved by electrophoresis on the photosensitive member 20K according to the electric field formed at the electrostatic latent image (image area: −100 V, non-image area: −500 V) on the photosensitive member 20K. Meanwhile, in the non-image area, electric field acts in a direction to press toner against the developing roller 54, so that toner remains as it is on the developing roller 54. Thereby, visible image is formed on the photosensitive member 20K by toner.

Toner having moved toward the photosensitive member 20K at the developing position is transferred primarily to the intermediate transfer belt 70 by proceeding to the image forming process on the downstream side. At the primary transfer portion, the photosensitive member 20K and the intermediate transfer belt 70 are opposed to each other, and the primary transfer roller 61K is abutted against a rear side of the intermediate transfer belt 70. A voltage, which is +200 to +300 V according to the present invention, having opposite polarity as charge characteristics of toner is applied to the primary transfer roller 61K, and the toner image formed on the photosensitive member 20K is moved onto the intermediate transfer belt 70 by electrophoresis. A small amount of toner in the order of a few % remains with carrier liquid on the photosensitive member 20K, but it is scraped off by the cleaning device 21K arranged downstream of a primary transfer portion T1K.

Meanwhile, toner remaining on the developing roller 54 is advanced to a collecting and reusing process. That is, the cleaning roller 58 is abutted against the developing roller 54 at an area downstream of the developing position. At the nip portion between the developing roller 54 and the cleaning roller 58, an electric field is generated by the difference in voltages respectively applied from the image developing power supply 202 and the cleaning power supply 204. Toner on the developing roller 54 that did not contribute to image forming at the developing position enters the nip portion and moves to the surface of the cleaning roller 58 by electrophoresis.

The cleaning blade 56 is abutted against the cleaning roller 58. Toner collected on the surface of the cleaning roller 58 from the developing roller 54 is scraped by the cleaning blade 56. Liquid developer flows toward the developer collecting tank 55 along the inclination of the cleaning blade 56.

In the present embodiment, during image forming, feeding of liquid developer from the mixer 59K to the developer tank 53 is performed continuously. In this state, supplied liquid developer advances to the area between the film forming electrode 51 and the developing roller 54 and is borne on the developing roller 54. In another case, the supplied liquid toner advances to the flushing channel 57 and contributes to flushing the cleaning roller 58.

A portion of the liquid developer supplied to the developer tank 53 leaks through the developer discharge port 532 from the developer tank 53 to the developer collecting tank 55. When feeding of liquid developer to the developer tank 53 is stopped, there will be no feeding of liquid developer to the surface of the developing roller 54 and to the flushing channel 57, and thereafter, liquid developer gradually leaks from the developer discharge port 532, and finally, the developer tank 53 becomes empty.

Voltage is respectively applied to the developing roller 54, the film forming electrode 51, the squeezing roller 52 and the cleaning roller 58, and serves as driving force of electrophoresis of toner. In the present embodiment, voltage respectively applied to the developing roller 54, the squeezing roller 52 and the cleaning roller 58 during image formation is, respectively, −300 V, −370 V and −150 V. The voltage applied to the film forming electrode 51 is controlled by image density detected by the toner image density sensor 87 provided on the intermediate transfer belt 70. This is caused by the level of movement, that is, moving velocity with respect to electric field intensity, of toner in the liquid developer contributing to image formation being varied according to the state of consumption of toner and the like. In the present embodiment, voltage applied to the film forming electrode 51 during image formation is, for example, −600 to −900 V.

In this state, the developing apparatus 50K operates so that the developing roller 54 abuts against and separates from the photosensitive member 20K with respect to the direction of the photosensitive member 20K by the image development attaching/detaching motor 205. In the present embodiment, the developing roller 54 and the photosensitive member 20K are abutted to each other with a contact pressure of 80±10 N during image formation. Before and after image forming operation, the operations of the developing roller 54 and the photosensitive member 20K are stopped at the separated state. The developing apparatuses 50Y, 50M and 50C are configured similarly.

Further, the developing roller 54, the squeezing roller 52 and the cleaning roller 58 are rotated at a substantially equivalent surface peripheral speed during image formation. Driving force for rotation is provided to the developing roller 54 from the developing roller motor 206, and drive force is distributed from the developing roller 54 to the squeezing roller 52 and the cleaning roller 58 through a gear. Therefore, in the present embodiment, the three roller members will simultaneously start and stop rotating.

In the case of the image forming apparatus 100 using liquid developer, in a state where sufficient amount of carrier liquid surrounds the toner in the liquid developer, toner is not mutually attached to each other due to the dispersing agent and the like contained in the liquid developer. That is, the toner is dispersed in carrier liquid in a state where particles of toner are separated one by one. In this case, toner is easily flown together with the carrier liquid, so that they are not easily attached to the respective roller members including the developing roller 54, the squeezing roller 52 and the cleaning roller 58. Meanwhile, in a state where not enough carrier liquid surrounds the toner in the liquid developer, toner may adhere to one another and concentrate by the effect of liquid cross-linking force among toner and intermolecular force. As described earlier, concentrated toner may adhere to the roller member and tend to cause image defects.

The above-described state of not enough carrier liquid surrounding the toner may easily occur if the developing apparatuses 50Y to 50K are stopped after image formation is completed, more specifically, if rotation of the developing roller 54, the squeezing roller 52 and the cleaning roller 58 is stopped. That is, if rotation of the roller members is stopped after completing image formation, liquid developer will remain at the nip portion between the developing roller 54 and other roller members. The amount of liquid developer that remains may be reduced by the carrier liquid dripping or evaporating along with the elapse of time, but in the case of the conventional image forming apparatus, if only carrier liquid is reduced from the liquid developer, toner in the liquid developer may condense and attach to the roller member. The condensed body of toner attached to the roller member remains on the surface of the roller member when image formation is resumed and may cause image defects. Even if collected by the cleaning roller 58, condensed toner may cause increase of apparent viscosity of liquid developer or deterioration of image quality.

Therefore, in the present embodiment, condensation of toner is suppressed by lowering the toner density as much as possible in the liquid developer remaining at the nip portion between the developing roller 54 and other roller members at the time the operation of the developing apparatus 50 is stopped. In addition, condensation of toner on the cleaning blade 56 is also suppressed by reducing toner remaining on the cleaning blade 56 compared to the prior art. The present embodiment will be described in detail in the following.

Operation Stop Control of Developing Apparatus

Figure 4:
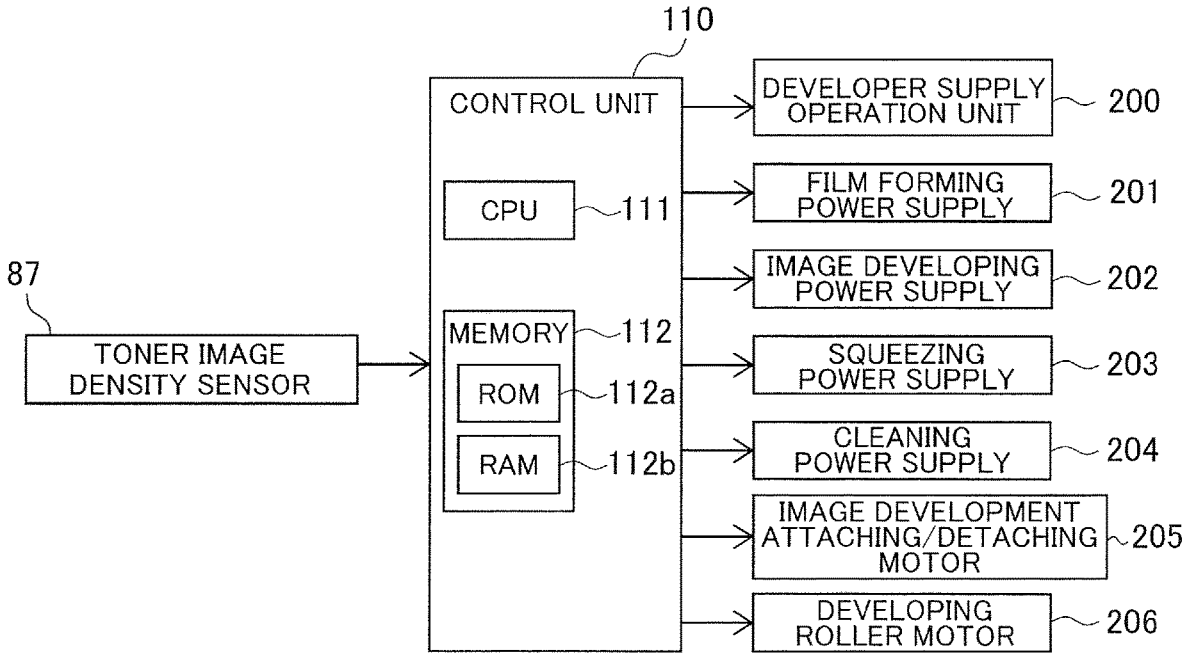
FIG. 4 is a control block diagram of the image forming apparatus according to the present embodiment.

Operation stop control, i.e., stop mode, of the developing apparatus 50 according to the present embodiment will be described based on FIGS. 5 to 7 with reference to FIGS. 2 and 4. In the present description, the developing apparatus 50K is described as an example, but the developing apparatuses 50Y, 50M and 50C are configured similarly, so the descriptions thereof are omitted.

Figure 5:
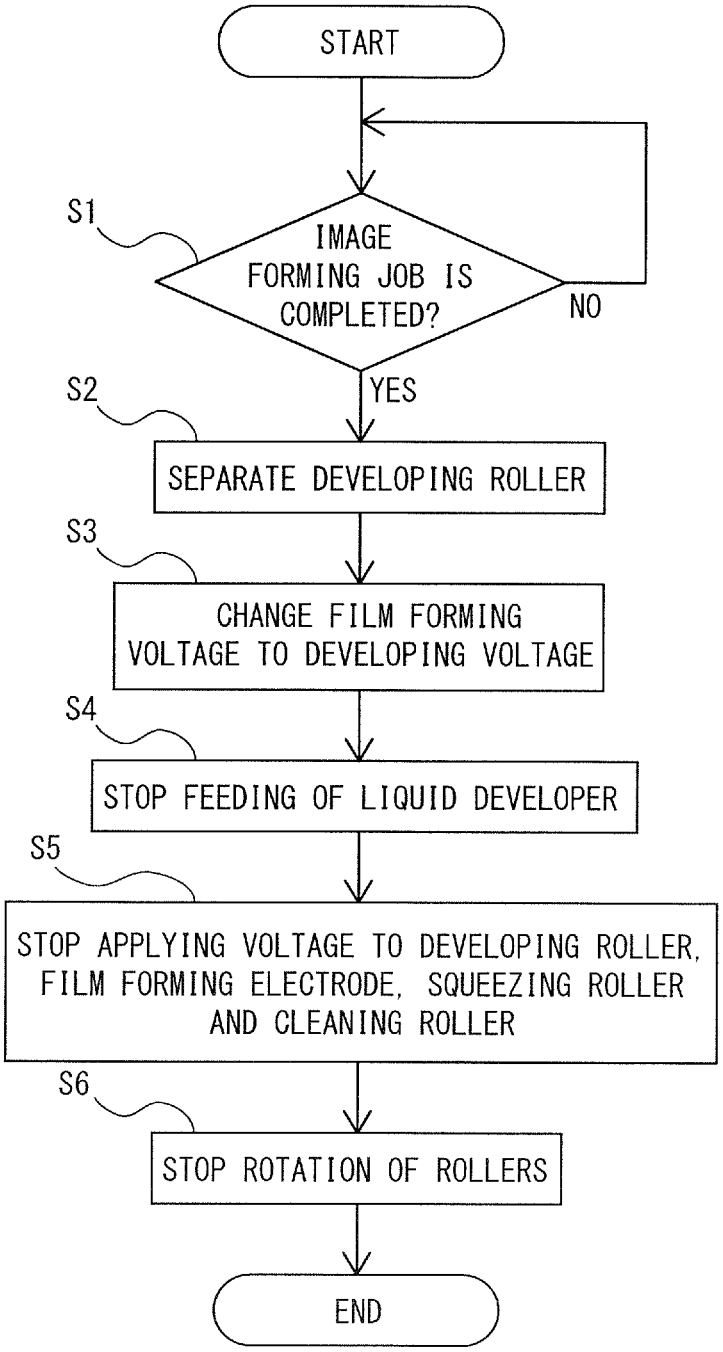
FIG. 5 is a flowchart of operation stop control of a developing apparatus.

As illustrated in FIG. 5, the control unit 110 determines whether to finish the image forming job (S1). The control unit 110 stands by without advancing the process until it is determined that the image forming job is to be finished (S1: NO), and if it is determined that the image forming job is to be finished (S1: YES), the processes of S2 and thereafter are executed. That is, at the time when the image forming job is finished (S1: YES), the control unit 110 controls the image development attaching/detaching motor 205 to move the developing apparatus 50K and separate the developing roller 54 from the photosensitive member 20K (S2).

In a state where the developing roller 54 is separated from the photosensitive member 20K, the control unit 110 controls the film forming power supply 201 and changes the film forming voltage applied to the film forming electrode 51 to a voltage approximately the same as the developing voltage applied to the developing roller 54 (S3). In the present embodiment, "approximately the same voltage" refers to a voltage where the difference between the film forming voltage after change and the developing voltage is 10% or smaller, more preferably 5% or smaller, of the difference between the film forming voltage and the developing voltage during image formation. In the present embodiment, the film forming voltage is changed to −300 V which is equal to developing voltage, i.e., voltage equal to developing voltage. Therefore, the potential difference with the developing voltage will be 0.

After the film forming voltage is changed as described above, the control unit 110 controls the developer supply operation unit 200 and stops supply of liquid toner from the mixer 59K to the developer tank 53 (S4). If the supply of liquid developer to the developer tank 53 is stopped, continuous leakage of liquid developer through the developer discharge port 532 causes the amount of liquid developer in the developer tank 53 to reduce. Then, the control unit 110 respectively controls the film forming power supply 201, the image developing power supply 202, the squeezing power supply 203 and the cleaning power supply 204 and stops application of voltage to the developing roller 54, the film forming electrode 51, the squeezing roller 52 and the cleaning roller 58 (S5). Thereafter, the control unit 110 controls a developing roller motor 504, stops the rotation of the developing roller 54, the squeezing roller 52 and the cleaning roller 58 (S6), and ends the present operation stop control.

Figure 6:
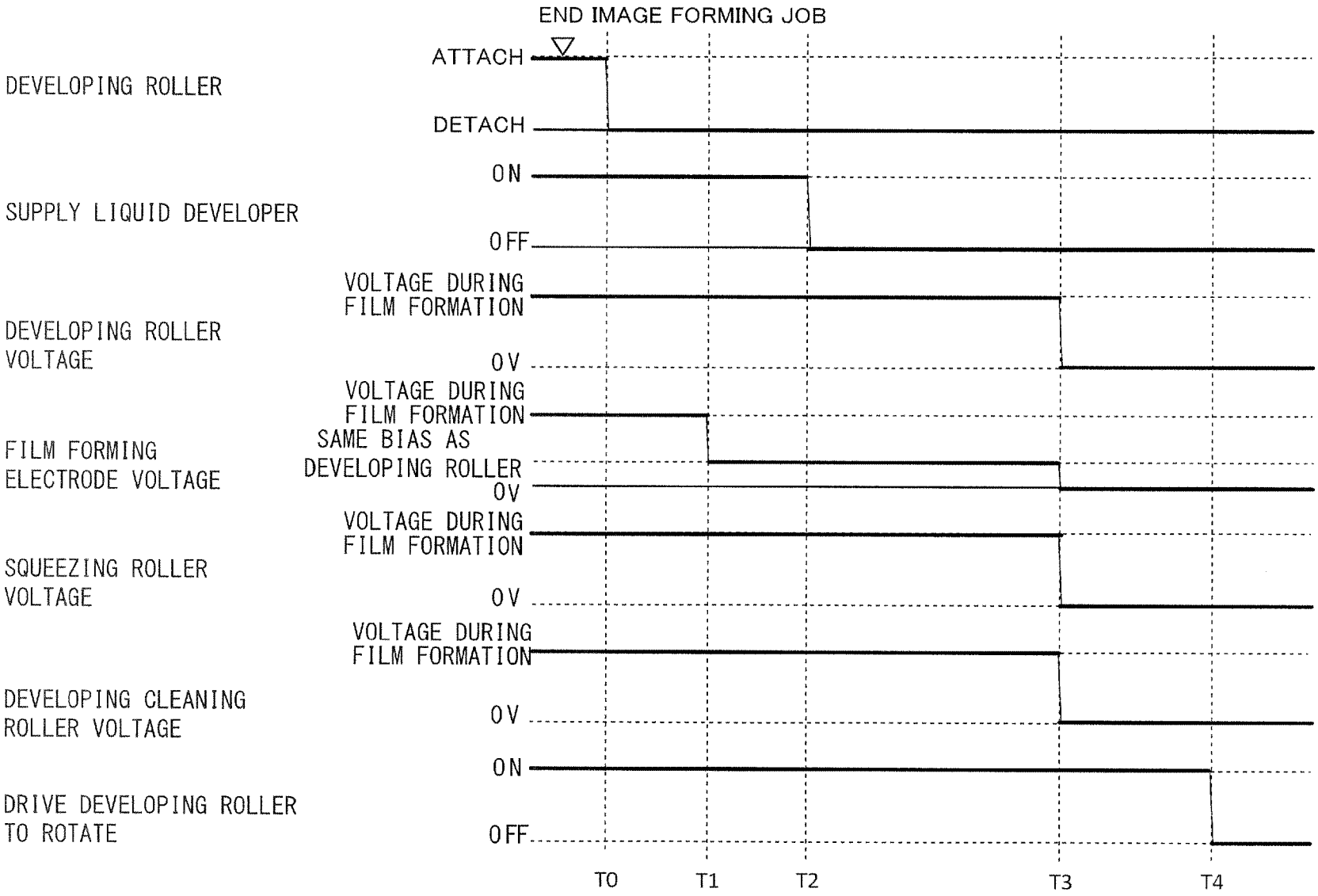
FIG. 6 is a timing chart illustrating operation stop control.
Figure 7:
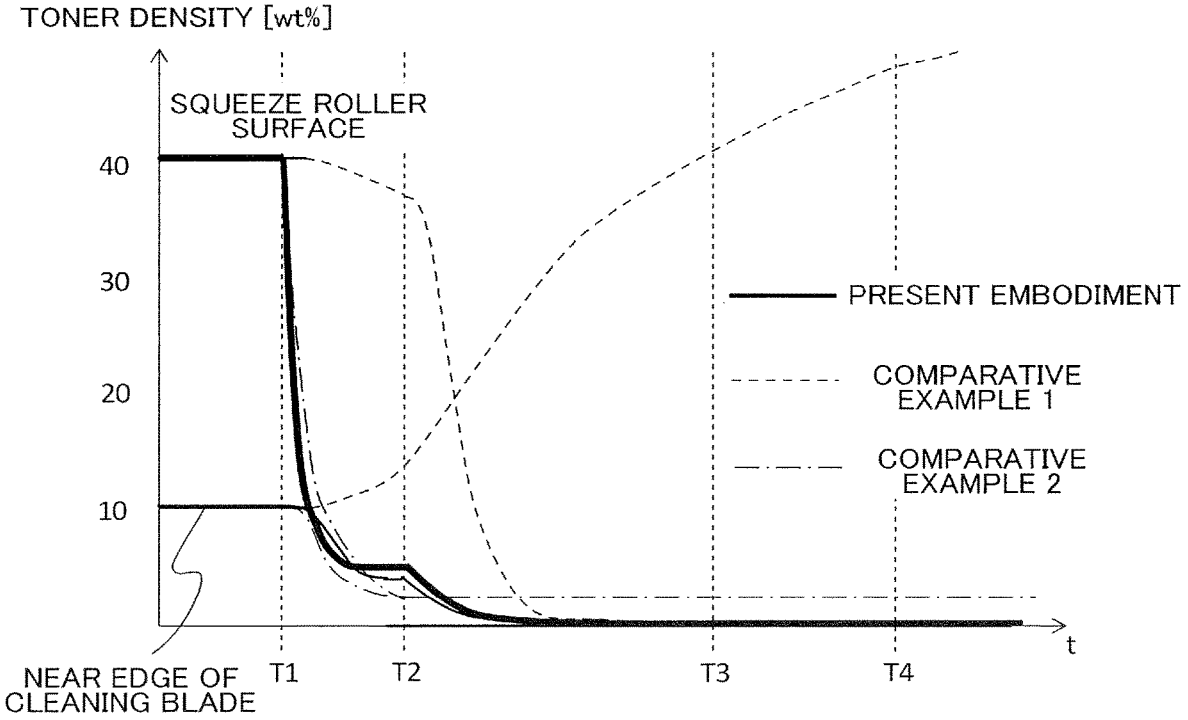
FIG. 7 is a graph illustrating transition of time of toner density in liquid developer.

FIG. 6 illustrates a timing chart of operation stop control of the developing apparatus 50 illustrated in FIG. 5. The time illustrated here (T0 to T4) illustrates a timing at which various operation commands, i.e., signals, have been generated from the control unit 110 to various portions (refer to FIG. 4). Further, FIG. 7 illustrates a time transition of toner density in the liquid developer. FIG. 7 illustrates the toner density of liquid developer on the developing roller 54 after passing the squeezing roller 52, in other words, at a point of time when it reaches the cleaning roller 58, and the toner density at the contact portion between the cleaning roller 58 and the cleaning blade 56. In FIG. 7, the time transition of toner density according to the present embodiment is illustrated by a solid line.

As illustrated in FIG. 6, in a state where the image forming job is ended, the developing roller 54 is separated from the photosensitive member 20K (time T0, refer to S2 of FIG. 5). At this point of time, voltage during image formation is still applied to each of the developing roller 54, the film forming electrode 51, the squeezing roller 52 and the cleaning roller 58. That is, film formation of liquid developer on the developing roller 54, concentration of liquid developer formed as a film on the developing roller 54 and removal of toner from the developing roller 54 are performed continuously according to the rotation of the developing roller 54. Since feeding of liquid developer to the developer tank 53 is maintained, flushing described above is also continued.

After separation of the developing roller 54, before stopping the feeding of liquid developer to the developer tank 53 described later (time T0 to T2), the film forming voltage is set to approximately the same voltage (such as −300 V) as the developing voltage (time T1, refer to S3 of FIG. 5). If the potential difference between the film forming voltage and the developing voltage is small, electrophoresis between the film forming electrode 51 and the developing roller 54 is suppressed, so that toner in the liquid developer borne on the developing roller 54 is not easily moved toward the developing roller 54. Thereby, the toner density in the liquid developer borne on the developing roller 54 becomes lower than approximately 40 wt % during image formation after passing the nip portion between the squeezing roller 52 and the developing roller 54. That is, in the present embodiment, as illustrated in FIG. 7 (time T1 to T2), the toner density of liquid developer on the developing roller 54 after passing the squeezing roller 52 is lowered to the same density, which is approximately 3.5 wt %, as the liquid developer supplied from the mixer 59K to the developer tank 53. In that case, the toner density of liquid developer on the developing roller 54 after passing the squeezing roller 52 will be approximately 5.0 wt %.

The toner density of liquid developer collected in the cleaning roller 58 will be approximately 8.0 wt %. Further, at a point of time when scraping is performed by the cleaning blade 56, if flushing is continued, toner density can be reduced to as low as approximately 4.5 wt %. If a predetermined time, such as five seconds or longer is elapsed after setting the film forming voltage and the developing voltage to approximately the same voltages, the liquid developer having a low viscosity, approximately 6.0 Pa·s, is flown stably along the cleaning blade 56. Then, toner is suppressed from remaining at the contact portion between the cleaning roller 58 and the cleaning blade 56.

It may be possible to stop application of film forming voltage, that is, to set the voltage to 0 V, without setting the film forming voltage to approximately the same voltage as the developing voltage in order to reduce the toner density of liquid developer on the developing roller 54 after passing the squeezing roller 52 compared to that during image formation. In that case, however, the direction of electric field formed between the film forming electrode 51 and the developing roller 54, that is, between developer bearing members, is reversed from that during image formation, and the toner in the liquid developer formed as a film on the developing roller 54 is pressed against the film forming electrode 51 and the toner may be attached to the film forming electrode 51. If toner is attached to the film forming electrode 51, the performance of the film forming electrode 51 is deteriorated, and image defects may be caused during subsequent image forming jobs. Therefore, it is difficult to adopt a process of stopping application of film forming voltage while maintaining the developing voltage of −300 V Next, after elapse of predetermined time from the setting of film forming voltage, such as five seconds or longer, in other words, after rotating the developing roller 54 for a predetermined time or longer, the feeding of liquid developer from the mixer 59K to the developer tank 53 is stopped (time T2, refer to S4 of FIG. 5). If feeding of liquid developer to the developer tank 53 is stopped, liquid developer leaks continuously through the developer discharge port 532 and the amount of liquid developer stored in the developer tank 53 reduces. Then, liquid developer will not be supplied to the developing roller 54 and the flushing channel 57 (refer to arrow A and arrow D of FIG. 2). In this state, as the liquid developer corotates with the developing roller 54, toner is removed by the cleaning roller 58. Then, by rotating the developing roller 54 for a predetermined time, such as five seconds or longer after the feeding of liquid developer is stopped, almost all the toner on the developing roller 54 is removed by the cleaning roller 58. That is, as illustrated in FIG. 7, after time T2, the toner density of liquid developer corotated with the developing roller 54 is reduced to approximately 0 wt % across the whole periphery. Then, almost no toner remains at the nip portion between the squeezing roller 52 and the developing roller 54. Further, toner density at the contact portion between the cleaning roller 58 and the cleaning blade 56 is also lowered to approximately 0 wt %. This is because flushing is stopped and liquid developer whose toner density is lowered to approximately 0 wt % is collected, so that the toner remaining on the cleaning blade 56 is reduced.

As described above, after the feeding of liquid developer to the developer tank 53 is stopped (time T2), the developing roller 54 is rotated for a few times before the application of voltage to the developing roller 54, the film forming electrode 51, the squeezing roller 52 and the cleaning roller 58 is stopped (time T3, refer to S5). The stopping of voltage application to various members can be performed at the same time, but in order to prevent generation of electric field directed to an opposite direction as that during image formation between the developing roller 54 and various members, it is preferable to stop voltage application, that is, to output a signal to turn off application of voltage, to the cleaning roller 58, the developing roller 54, the squeezing roller 52 and the film forming electrode 51 in the named order. For example, after stopping feeding of liquid developer to the developer tank 53, it is preferable to stop application of voltage, that is, to output a signal to turn off application of voltage, to the cleaning roller 58 at first, and thereafter, to stop application of voltage to the developing roller 54, the squeezing roller 52 and the film forming electrode 51 in the named order with a time difference of 0.5 seconds. After elapse of a predetermined time, such as three seconds, after application of voltage to respective members is stopped, the rotation of the developing roller 54, together with the squeezing roller 52 and the cleaning roller 58, is stopped, that is, signal to stop rotation is output (time T2, refer to S6 of FIG. 5).

Comparative Example

As comparative examples, the present inventors carried out an experiment to measure the toner density of liquid developer on the developing roller 54 having passed the squeezing roller 52 and the toner density at the contact portion of the cleaning blade 56 regarding cases where other operation stop controls described below have been performed. As other operation stop controls, a first control is a control where the feeding of liquid developer to the developer tank 53 is stopped, and thereafter, application of voltage to the developing roller 54, the film forming electrode 51, the squeezing roller 52 and the cleaning roller 58 are stopped (comparative example 1). A second control is a control where application of voltage to the developing roller 54, the film forming electrode 51, the squeezing roller 52 and the cleaning roller 58 is stopped, and thereafter, feeding of liquid developer to the developer tank 53 is stopped (comparative example 2). For comparison with the present embodiment, the results of the comparative examples 1 and 2 are illustrated in FIG. 7. In FIG. 7, the result of comparative example 1 is illustrated by a dashed line, and the result of comparative example 2 is illustrated by a dash-dot line.

Comparative example 1 will be described. In the case of the comparative example 1, at first, feeding of liquid developer to the developer tank 53 is stopped (time T1), and thereafter, application of voltage to the developing roller 54, the film forming electrode 51, the squeezing roller 52 and the cleaning roller 58 is stopped (time T3). As illustrated in FIG. 7, when feeding of liquid developer to the developer tank 53 is stopped (time T1), the amount of liquid developer fed to the developing roller 54 is gradually reduced with the elapse of time, and finally, feeding of liquid developer is stopped (time T2). In this case, until the feeding of liquid developer to the developing roller 54 is stopped (time T1 to T2), the toner density of liquid developer after passing the squeezing roller 52 is maintained to 40±5 wt %. This is because, as mentioned above, the liquid developer on the developing roller 54 is concentrated by the squeezing roller 52. When liquid developer is no longer supplied to the developing roller 54 (time T2), since toner is collected by the cleaning roller 58, the toner density of liquid developer corotated with the developing roller 54 is reduced to approximately 0 wt % along the whole circumference (time T2 and thereafter). Therefore, adhesion of toner is suppressed at the nip portion between the developing roller 54 and the squeezing roller 52 and at the nip portion between the developing roller 54 and the cleaning roller 58.

Meanwhile, according to comparative example 1, toner tends to remain on the cleaning blade 56. That is, after the feeding of liquid developer to the developing roller 54 is stopped (time T1 to T2) and the toner density of liquid developer corotated with the developing roller 54 drops to approximately 0 wt %, the cleaning blade 56 continues to scrape off toner. Further, when the feeding of liquid developer to the developing roller 54 is gradually reduced, flushing becomes difficult. Therefore, the amount of toner remaining on the cleaning blade 56 increases. After application of voltage to the developing roller 54, the film forming electrode 51, the squeezing roller 52 and the cleaning roller 58 is stopped (time T3) and rotation of the developing roller 54 is stopped (time T4), the amount of carrier liquid is reduced by flowing or evaporating, and the toner density becomes high. Then, toner tends to concentrate, and image defects may be caused by toner concentration.

Comparative example 2 will be described. In the case of comparative example 2, at first, application of voltage to the developing roller 54, the film forming electrode 51, the squeezing roller 52 and the cleaning roller 58 is stopped (time T1), and thereafter, feeding of liquid developer to the developer tank 53 is stopped (time T2). In this case, after time T1, toner will not move toward the developing roller 54 since electrophoresis is not generated at the film forming electrode 51 after time T1. Further, concentration of liquid developer on the developing roller 54 by the squeezing roller 52 will not occur. Furthermore, collection of toner by the cleaning roller 58 will also not occur. However, until the feeding of liquid developer is stopped, toner density of liquid developer corotated with the developing roller 54 is reduced by the supplied liquid developer (time T1 to T2). After time T2 when feeding of liquid developer is stopped, liquid developer supplied to the developer tank 53 is corotated with the developing roller 54. Therefore, the toner density of liquid developer corotated with the developing roller 54 is maintained to approximately 3.5 wt % which is similar to the liquid developer supplied to the developer tank 53. In this case, even though the toner density is low, if the stopped state after stopping of rotation of the developing roller 54 (time T3) is continued for a long time, toner may be concentrated, and image defects caused by concentrated toner may occur.

Further according to comparative example 2, in a state where application of voltage to the cleaning roller 58 is stopped (time T1), toner will not be collected by the cleaning roller 58, so that toner remaining on the cleaning blade 56 will not increase. Further, since feeding of liquid developer to the developer tank 53 will be continued until time T2, liquid developer supplied by flushing reaches the cleaning blade 56, and toner remaining on the cleaning blade 56 will be flushed and cleaned. After rotation of the developing roller 54 is stopped (after time T3), liquid developer having a toner density of approximately 3.5 wt % which had been supplied by flushing mainly remains on the cleaning blade 56. Even according to this case, toner density is low as described above, but if the stopped state after stopping of rotation of the developing roller 54 and the cleaning roller 58 is maintained for a long time, toner is condensed, and image defects caused by condensed toner may occur.

As described, according to the present embodiment, in a state where rotation of the developing roller 54, the squeezing roller 52 and the cleaning roller 58 is stopped, at first, the film forming voltage is changed to approximately the same voltage as the developing voltage prior to stopping the rotation. If a predetermined time or longer has elapsed after the film forming voltage had been changed, the toner density of liquid developer on the developing roller 54 after passing the squeezing roller 52 is reduced greatly compared to that during image formation. Then, when the developing roller 54 is rotated for a predetermined time or more after stopping feeding of liquid developer to the developer tank 53, the toner density of liquid developer corotated with the developing roller 54 is reduced to approximately 0 wt % across the whole circumference. Further, in accordance therewith, the toner density at the contact portion between the cleaning roller 58 and the cleaning blade 56 is also lowered to approximately 0 wt %. In this state, application of voltage to the developing roller 54, the film forming electrode 51, the squeezing roller 52 and the cleaning roller 58 is stopped, and the rotation of the developing roller 54, together with the squeezing roller 52 and the cleaning roller 58, is stopped. Thereby, in a case where the developing roller 54 is stopped, since only a very small amount of toner is contained in the liquid developer remaining at the nip portion between the developing roller 54 and other roller members, concentration of toner will not occur easily even if carrier liquid is reduced by elapse of time. Further, only a very small amount of toner remains on the cleaning blade 56, so that concentration of toner is suppressed. As described, according to the present embodiment, suppression of image defects caused by liquid developer remaining at the nip portion between the developing roller 54 and other roller members and suppression of image defects caused by toner removed by the cleaning blade 56 can be realized at the same time by a simple control.

Other Embodiments

According to the embodiment described above, during operation stop control, that is, during execution of stop mode, of the developing apparatus 50, the film forming voltage was changed to approximately the same voltage as the developing voltage (refer to S2 of FIG. 5), but the present invention is not limited to this example. For example, it is possible to change the film forming voltage to be lower by absolute value (such as −400 V) than the voltage during image formation (−600 to −900 V) while maintaining the developing voltage (−300 V). However, in that case, in order to avoid attachment of toner to the film forming electrode 51, the film forming voltage is changed to a voltage greater by absolute value than the developing voltage so that the direction of electric field formed between the film forming electrode 51 and the developing roller 54 is maintained to a same direction as that during image formation. Further, it is also possible to change the film forming voltage and the developing voltage to approximately the same voltage by changing not only the film forming voltage but also the developing voltage (such as to −280 V). In that case, however, the film forming voltage and the developing voltage are changed to approximately the same voltages so that the direction of the electric field formed between the developing roller 54 and the cleaning roller 58, that is, between the cleaning roller, is maintained to the same direction as that during image formation. In extreme, it is possible to change all the voltages of the film forming voltage (such as −200 V), the developing voltage (such as −200 V), the squeezing voltage (such as −270 V) and the cleaning voltage (such as −50 V). However, in comparison to such example, the above-described embodiment where only the film forming voltage is set can be controlled simply and is more preferable.

In the embodiment described above, the image forming apparatus 100 being explained adopts a configuration where toner images of respective colors are primarily transferred from the photosensitive members 20Y to 20K corresponding to respective colors to the intermediate transfer belt 70, and thereafter, a full-color toner image composed of respective colors is collectively secondarily transferred to the recording material, but the present invention is not limited to this example. The above-described embodiment can also be applied to a direct transfer-type image forming apparatus where image is transferred directly from the photosensitive members 20Y to 20K to a recording material borne and conveyed on the transfer material conveyor belt, for example.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

The present image forming apparatus can be applied as an image forming apparatus to a copying machine, a printer, a facsimile, or a multifunction device having a plurality of such functions, and especially, applied preferably to those using liquid developer.

As described above, both suppression of image defects caused by liquid developer remaining between the developing roller and other roller members and suppression of image defects caused by toner removed by the cleaning blade can be realized by a simple configuration.

What is claimed is:

1. An image forming apparatus comprising:

a photosensitive member;

a rotatable developer bearing member configured to bear liquid developer containing toner and carrier liquid and develop, by being applied voltage, an electrostatic latent image formed on the photosensitive member at a developing portion;

a feeding unit configured to feed liquid developer to the developer bearing member;

a film forming electrode arranged downstream of the feeding unit in a direction of rotation of the developer bearing member and configured to form a film of liquid developer being supplied to the developer bearing member in a state where a voltage is applied thereto;

an abutment roller arranged downstream of the film forming electrode and upstream of the developing portion in the direction of rotation of the developer bearing member and configured to abut against the developer bearing member;

a cleaning roller arranged downstream of the developing portion and upstream of the feeding unit in the direction of rotation of the developer bearing member and configured to abut against the developer bearing member and remove toner on the developer bearing member after developing an image;

a removing member configured to abut against the cleaning roller and remove toner on the cleaning roller; and a control unit configured to execute a stop mode in which, after image forming operation is stopped, the developer bearing member is rotated for a predetermined time with a potential difference between the film forming electrode and the developer bearing member set to zero or less than the difference during image formation, and thereafter, the rotation of the developer bearing member is stopped, wherein during execution of the stop mode, the control unit outputs a signal to stop feeding of liquid developer by the feeding unit after the developer bearing member has been rotated for the predetermined time with the potential difference between the film forming electrode and the developer bearing member set to zero or less than the difference during image formation and before outputting a signal to turn off application of voltage to the developer bearing member and the film forming electrode.

2. The image forming apparatus according to claim 1, wherein during execution of the stop mode, the control unit changes the voltage applied to the film forming electrode so that the potential difference between the film forming electrode and the developer bearing member becomes either zero or not more than 10% of the potential difference between the film forming electrode and the developer bearing member during image formation.

3. The image forming apparatus according to claim 1, wherein during execution of the stop mode, the control unit reduces an absolute value of the voltage applied to the film forming electrode than that applied during image formation.

4. The image forming apparatus according to claim 1, wherein during execution of the stop mode, the controller outputs a signal to stop rotation of the developer bearing member after outputting the signal to turn off application of voltage to the developer bearing member and the film forming electrode.

5. The image forming apparatus according to claim 1, wherein voltage is applied to the abutment roller and the cleaning roller, and wherein during execution of the stop mode, the control unit outputs a signal to turn off application of voltage to the cleaning roller, the developer bearing member, the abutment roller and the film forming electrode in a named order.

6. The image forming apparatus according to claim 1, wherein voltage is applied to the abutment roller, and wherein during execution of the stop mode, the control unit sets the potential difference between the film forming electrode and the developer bearing member to be smaller than that during image formation without changing a direction of electric field formed between the abutment roller and the developer bearing member during image formation.

7. The image forming apparatus according to claim 1, further comprising an abutment/separation unit configured to move the developer bearing member between an abutment position abutted against the photosensitive member and a separated position separated from the photosensitive member, wherein during execution of the stop mode, the control unit controls the abutment/separation unit to move the developer bearing member from the abutment position to the separated position before the developer bearing member has been rotated for the predetermined time with the potential difference between the film forming electrode and the developer bearing member set to zero or less than the difference during image formation.

* * * * *